US007384537B2

(12) United States Patent
Nagamatsu et al.

(10) Patent No.: US 7,384,537 B2
(45) Date of Patent: Jun. 10, 2008

(54) REFINED OIL AND PROCESS FOR PRODUCING THE SAME

(75) Inventors: Shigeki Nagamatsu, Yokohama (JP); Makoto Inomata, Higashi-ibaraki-gun (JP); Susumu Kasahara, Yokohama (JP)

(73) Assignee: JGC Corporation, Tokyo (JP)

( * ) Notice: Subject to any disclaimer, the term of this patent is extended or adjusted under 35 U.S.C. 154(b) by 411 days.

(21) Appl. No.: 10/399,875

(22) PCT Filed: Oct. 19, 2001

(86) PCT No.: PCT/JP01/09183

§ 371 (c)(1),
(2), (4) Date: Sep. 4, 2003

(87) PCT Pub. No.: WO02/34865

PCT Pub. Date: May 2, 2002

(65) Prior Publication Data

US 2004/0031725 A1 Feb. 19, 2004

(30) Foreign Application Priority Data

Oct. 24, 2000 (JP) ..... 2000-323614

(51) Int. Cl.
*C10G 45/00* (2006.01)
*C10G 65/00* (2006.01)
*C10G 47/02* (2006.01)

(52) U.S. Cl. ..... 208/89; 208/58; 208/108; 208/210

(58) Field of Classification Search ..... 208/108, 208/89, 14, 15, 58, 210
See application file for complete search history.

(56) References Cited

U.S. PATENT DOCUMENTS

| | | | | |
|---|---|---|---|---|
| 3,766,058 | A | 10/1973 | Hensley, Jr. | |
| 3,860,510 | A | 1/1975 | Henke et al. | |
| 3,977,962 | A | 8/1976 | Arey, Jr. et al. | |
| 4,016,067 | A | 4/1977 | Fischer et al. | |
| 4,054,508 | A | 10/1977 | Milstein et al. | |
| 4,251,347 | A * | 2/1981 | Rausch et al. | 208/57 |
| 5,009,768 | A | 4/1991 | Galiasso et al. | |
| 5,382,349 | A * | 1/1995 | Yoshita et al. | 208/49 |

FOREIGN PATENT DOCUMENTS

| | | |
|---|---|---|
| EP | 0 041 284 B1 | 12/1981 |
| JP | 6-207180 | 7/1994 |
| JP | 2000-239677 | 9/2000 |
| JP | 2000-282060 | 10/2000 |
| JP | 2000-282069 | 10/2000 |
| JP | 2000-282069 A1 | 10/2000 |
| JP | 2001-89769 A1 | 4/2001 |

* cited by examiner

*Primary Examiner*—Glenn Caldarola
*Assistant Examiner*—John Douglas
(74) *Attorney, Agent, or Firm*—Darby & Darby PC

(57) ABSTRACT

According to the method of manufacturing refined oil of the present invention, refined oil which has a viscosity of 20 cst or lower at 135° C., a pour point of 30° C. or lower, an alkali metal content of 1 wt ppm or less, a vanadium content of 10 wt ppm or less and a sulfur content of 0.3 wt % or lower can be prepared, by bringing feed oil into contact with hydrogen in the presence of the demetalizing/desulfurizing catalyst 3 and the hydrogenolysis catalyst 5. This method can decrease the viscosity, pour point and sulfur concentration of the refined oil to sufficiently low levels, and decreases the production cost.

14 Claims, 2 Drawing Sheets

REFINED OIL AND PROCESS FOR PRODUCING THE SAME

TECHNICAL FIELD

The present invention relates to refined oil and to a method of manufacturing the same, and more particularly, to refined oil which can be preferably used as gas turbine fuel oil or the like for applications such as a combined cycle power generation, and to a method of manufacturing the same.

BACKGROUND ART

The combined cycle power generation has been commercially practiced in which a gas turbine is driven by a gas of high temperature and high pressure that is generated by burning a fuel such as natural gas, while steam generated by using waste heat from the gas turbine is used to drive a steam turbine.

While natural gas is predominantly used as the fuel for these gas turbines, use of natural gas involves problems such as the high cost of storing and transporting the natural gas.

To avoid these problems, technologies have recently been developed to manufacture refined oil, which can be used as the gas turbine fuel oil, instead of the natural gas, from crude oil.

Japanese Patent Publication, First Publication No. 6-209600 discloses a technology to prepare refined oil which is preferably used as the gas turbine fuel oil by having low-sulfur crude oil react with hydrogen in the presence of a desulfurizing catalyst, thereby reducing the content of sulfur and heavy metals in the refined oil.

However, since the method disclosed in the publication mentioned above requires the use of low-sulfur crude oil as the raw material, a large amount of sulfur is included in the refined oil in the case of crude oil which has a high sulfur content is used. This results in the exhaust gas from the gas turbine containing a large amount of sulfur oxide, which is a problem that must be solved for environmental conservation.

Japanese Patent Publication, First Publication No. 2000-273467 (first publication date: Oct. 3, 2000) discloses a technique for producing a gas turbine fuel oil by hydrogenation of gas oil which has been obtained from crude oil through processes such as fractional distillation and solvent deasphalting, in the presence of a demetalizing/desulfurizing catalyst.

This method of refining gas oil by hydrogenation is capable of yielding refined oil suitable as a fuel having a viscosity of 4 cst or less, an alkali metal content of 1 wt ppm or less, a lead content of 1 wt ppm or less, a vanadium content of 0.5 wt ppm or less, a calcium content of 2 wt ppm or less, and a sulfur content of 500 wt ppm or less.

However, this method of manufacturing refined oil has problems such as the following.

(1) When heavy species of oil (heavy oil which includes a large amount of high-boiling point components and high concentration of ashphaltene such as, for example, crude oil, atmospheric residue, vacuum residue, deasphalted oil made from these species of oil through solvent deasphalting, vacuum gas oil and tar sand) are used as the feed oil, the viscosity of the refined oil prepared may be higher than the value described above. Use of such refined oil as the fuel results in problems such as poor atomizing characteristics of the fuel oil and poor combustion characteristics in the gas turbine.

(2) Although it is possible, even when a heavy species of oil is used as the feed oil, to lower the viscosity and pour point of the gas oil which is charged to hydrogenation refining process by regulating the operating conditions of the fractional distillation process and solvent deasphalting process while decreasing the yield of the refined oil, this leads to higher production cost due to the lower yield of the refined oil.

(3) Also, when heavy species of oil are used as the feed oil for the purpose of preparing refined oil for broad applications such as petrochemical industrial material, too it is possible to lower the viscosity and pour point of the refined oil by increasing the reaction temperature and pressure of the hydrogenation refining process. However, the effects tend to be insufficient, and in addition, increases in the operation cost and equipment cost cannot be avoided.

DISCLOSURE OF THE INVENTION

The present invention has been completed in order to solve the problems described above, and it is an object of the invention to provide refined oil and a method of manufacturing the same that are capable of decreasing the viscosity, pour point, and sulfur content of the refined oil to practical satisfactory levels even when heavy species of feed oil are used, and can minimize production costs.

According to the method of manufacturing refined oil of the present invention, the feed oil is brought into contact with hydrogen in the presence of a demetalizing/desulfurizing catalyst and a hydrogenolysis catalyst, thereby to obtain the refined oil having viscosity of 20 cst or lower at 135° C., pour point of 30° C. or lower, alkali metal content of 1 wt ppm or less, vanadium content of 10 wt ppm or less and sulfur content of 0.3 wt % or lower.

According to the method of manufacturing refined oil of another aspect of the present invention, feed oil which has a vanadium content not higher than 150 wt ppm is brought into contact with hydrogen in the presence of a demetalizing/desulfurizing catalyst and a hydrogenolysis catalyst, thereby obtaining refined oil to be used as gas turbine fuel oil having a viscosity of 20 cst or lower at 135° C., a pour point of 30° C. or lower, an alkali metal content of 1 wt ppm or less, a vanadium content of 0.5 wt ppm or less and a sulfur content of 0.3 wt % or lower.

According to the method of manufacturing refined oil of the present invention, since the feed oil is brought into contact with hydrogen in the presence of the demetalizing/desulfurizing catalyst and the hydrogenolysis catalyst, not only can the concentrations of impurities such as metals (alkali metals, vanadium, etc.) and sulfur be decreased sufficiently by the demetalizing/desulfurizing catalyst, but also the viscosity and pour point can be lowered by decomposition, cracking into smaller molecules, or isomerization of a part of the feed oil by means of the hydrogenolysis catalyst.

Consequently, the following effects can be achieved.

(1) Even when a heavy species of oil is used as the feed oil, viscosity and pour point of the refined oil can be reduced to satisfactory levels. This makes it possible to produce refined oil having superior characteristics which does not require heating operation during storage, transportation, and use.

(2) Refined oil having a viscosity and pour point which are sufficiently low can be prepared even when the conditions of reactions in the fractional distillation process and the solvent deasphalting process are set so as to maintain a favorable level of yield when refining the feed oil. Thus, it is made possible to improve the yield of produced refined oil and to decrease the production cost.

(3) Refined oil having sufficiently low levels of viscosity and pour point can be prepared even when the temperature and pressure of reaction during contact of the feed oil with hydrogen are set lower than those in the prior art process which uses demetalizing/desulfurizing catalyst only. Thus, the operation cost and the equipment cost can be kept low.

(4) Since the separation of sulfur from the feed oil is accelerated by the hydrogenolysis catalyst, refined oil having low sulfur content can be prepared even when feed oil which includes high sulfur content is used.

(5) When feed oil having a vanadium content of 150 wt ppm or less is used, in particular, refined oil having a vanadium content of 0.5 wt ppm or less can be prepared, which is preferably used as gas turbine fuel oil.

With the effects (1) to (5) described above, the method of the present invention can lower the viscosity and the pour point of the refined oil to sufficiently low levels and keep the production cost to a low level.

For the feed oil, atmospheric residue obtained by distilling the crude oil under atmospheric pressure can be used.

For the feed oil, vacuum gas oil can also be used which is obtained by vacuum distillation of the atmospheric residue obtained by distilling the crude oil under atmospheric pressure.

For the feed oil, vacuum residue can also be used which is obtained by vacuum distillation of the atmospheric residue obtained by distilling the crude oil under atmospheric pressure.

For the feed oil, atmospheric residuary deasphalted oil can also be used which is obtained by solvent deasphalting of the atmospheric residue obtained by distilling the crude oil under atmospheric pressure.

For the feed oil, vacuum residuary deasphalted oil can also be used which is obtained by solvent deasphalting of the vacuum residue obtained by vacuum distillation of the atmospheric residue, that is obtained by distilling the crude oil under atmospheric pressure.

For the feed oil, two or more may also be used which are selected from among a group consisting of the atmospheric residue obtained by distilling the crude oil under atmospheric pressure, the vacuum gas oil obtained by vacuum distillation of the atmospheric residue, the vacuum residue obtained by vacuum distillation of the atmospheric residue, the atmospheric residuary deasphalted oil obtained by solvent deasphalting of the atmospheric residue, the vacuum residuary deasphalted oil obtained by solvent deasphalting of the vacuum residue and crude oil.

Heavy oil having boiling point of 340° C. or higher may also be used as the feed oil.

According to the present invention, contact of the feed oil with hydrogen can be performed in a hydrogenolysis catalyst layer after bringing the feed oil into contact with hydrogen in a demetalizing/desulfurizing catalyst layer, using a reactor vessel comprising the demetalizing/desulfurizing catalyst layer which consists of a demetalizing/desulfurizing catalyst and the hydrogenolysis catalyst layer which consists of a hydrogenolysis catalyst, with the demetalizing/desulfurizing catalyst layer being installed in the upstream of the hydrogenolysis catalyst layer in the direction of the feed oil flow.

The refined oil of the present invention is refined oil prepared by the method described above.

BEST MODE FOR CARRYING OUT THE INVENTION

Figure 1:
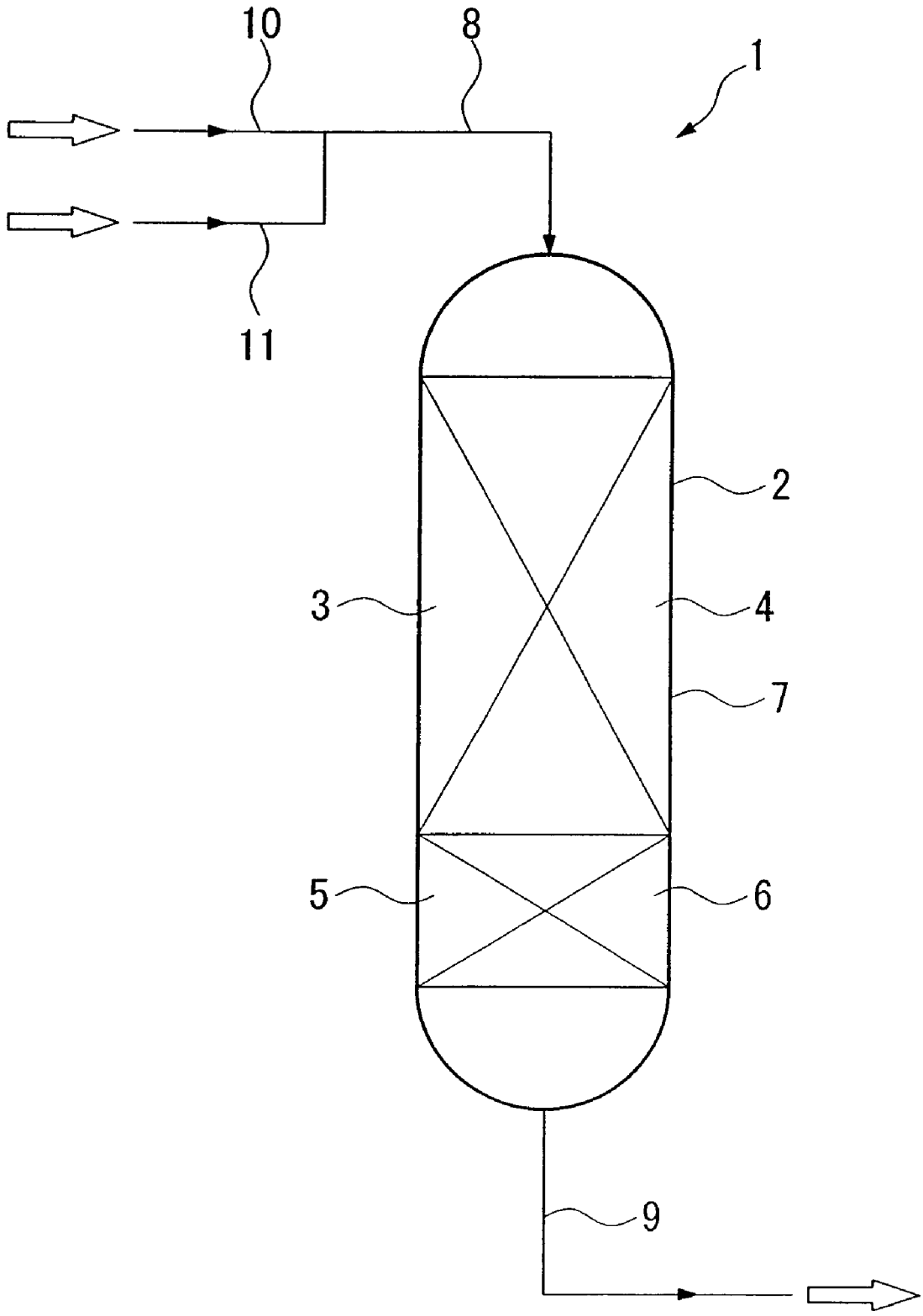
FIG. 1 is a schematic diagram showing a manufacturing apparatus preferably used for implementing an embodiment of the method of manufacturing refined oil of the present invention.

FIG. 1 shows a manufacturing apparatus preferably used for carrying out the method of producing refined oil of the present invention.

The manufacturing apparatus 1 shown in this drawing has a catalytic reactor tower 7 which is a reaction vessel comprising an external container 2 that houses a demetalizing/desulfurizing catalyst layer 4 consisting of a demetalizing/desulfurizing catalyst 3 and a hydrogenolysis catalyst layer 6 consisting of a hydrogenolysis catalyst 5.

For the demetalizing/desulfurizing catalyst 3, a general-purpose catalyst used when refining feed oil by hydrogenation (demetalization and desulfurization process) can be employed.

The demetalizing/desulfurizing catalyst 3 may be an alumina carrier or a silica-alumina carrier which supports a catalyst of at least one kind selected from among nickel, cobalt, molybdenum and tungsten. The demetalizing/desulfurizing catalyst 3 may be sulfurized before use.

There is no limitation to the shape of the demetalizing/desulfurizing catalyst 3, which may be, for example, cylindrical, square prismatic, or spherical. The cross section of the demetalizing/desulfurizing catalyst 3 may be formed in a 3-lobed or 4-lobed configuration. The diameter of the catalyst 3 may be in a range from 0.5 to 5 mm, although there is no restriction in the present invention.

The shape and dimensions of the catalyst 3 can be determined in accordance to the property of the feed oil and the concentration of the component to be removed.

The hydrogenolysis catalyst 5 may be one used in the ordinary hydrocracking process, as long as it has hydrogenation activity, cracking capability or isomerization activity. For the hydrogenolysis catalyst 5, one that includes a component having cracking capability, or isomerization activity and a component having hydrogenation activity may be used.

As the component having cracking activity or isomerization activity, at least one selected from among the group consisting of silica, alumina, magnesia, zirconia, boria, titania, calcia and zinc oxide may be used. Among these, it is particularly preferable to use an amorphous material such as silica-alumina, silica-magnesia, silica-titania, or silica-zirconia. Crystalline materials such as zeolite may also be used.

As the component having hydrogenation activity, at least one selected from among a group consisting of nickel, cobalt, molybdenum, platinum, chromium, tungsten, iron, and palladium may be used. Among these, it is particularly preferable to use nickel, cobalt, molybdenum, or platinum.

The component having hydrogenation activity may be included in the catalyst 5 either in elemental form, or in the form of an oxide or sulfide thereof. This component may also be distributed either over the entire body of the catalyst 5, or only in the vicinity of the surface of the component which has cracking activity (such as silica-alumina). That is, the component having hydrogenation activity may be supported on the component having cracking activity.

Total content of the components having hydrogenation activity is preferably in a range from 1 to 25% by weight, and more preferably in a range from 2 to 20% by weight of the catalyst 5.

When the content is below the range described above, hydrogenation activity decreases, and when the content is higher than the range described above, specific surface area of the catalyst 5 decreases.

There is no limitation to the shape of the catalyst 5, which may be, for example, cylindrical, square prismatic, or spherical. The cross section of the catalyst 5 may be formed in a 3-lobed or 4-lobed configuration. Diameter of the catalyst 5 may be in a range of 0.5 to 5 mm, although there is no restriction.

The shape and dimensions of the catalyst 5 can be determined in accordance to the molecular weight of the feed oil and the concentration of the component to be removed.

As the specific examples of the hydrogenolysis catalyst 5, those listed in PETROTECH, vol. 22, No. 12, pp. 1302-1037, 1999, may be used.

The catalytic reaction tower 7 of the manufacturing apparatus 1 is provided with the hydrogenolysis catalyst layer 6 which is installed downstream of the demetalizing/desulfurizing catalyst layer (downstream in the direction of the feed oil flow).

Connected to the top of the catalytic reaction tower 7 is a feed pipe 8 that supplies the feed oil and hydrogen into the catalytic reaction tower 7. Connected to the bottom of the catalytic reaction tower 7 is a discharge pipe 9 that discharges reaction product from the catalytic reaction tower 7.

Now an example of the method of manufacturing the refined oil according to the present invention will be described below taking a case of using the manufacturing apparatus 1.

According to the invention, crude oil, oil extracted from crude oil by a separating operation such as distillation or solvent deasphalting, or a mixture thereof, may be used as the feed oil.

Specifically, atmospheric residue, vacuum gas oil, vacuum residue, atmospheric residuary deasphalted oil, vacuum residuary deasphalted oil, crude oil or the like may be used.

These species of oil will be briefly described below.

(1) Atmospheric Residue

Atmospheric residue is produced by distillation of crude oil under atmospheric pressure, in such a process as the crude oil is supplied to an atmospheric distillation tower with high-boiling point components being collected under atmospheric pressure.

Specifically, such a method can be employed as the crude oil is distilled in the atmospheric distillation tower so as to separate low-boiling point components and high-boiling point components of the crude oil by making use of the difference in the boiling temperature, while the high-boiling point components is collected as the atmospheric residue from the bottom of the tower.

The temperature to heat the crude oil during the distillation process can be set so that components having boiling points of 320 to 380° C. or higher are collected as the high-boiling point components.

The atmospheric residue may be petroleum pitch, asphalt, bitumen, tar sand residue, liquefied coal residue or the like.

(2) Vacuum Gas Oil

Vacuum gas oil is prepared by distilling, under a reduced pressure, the atmospheric residue which is obtained by distillation of crude oil under the atmospheric pressure, in such a process as the atmospheric residue is supplied to a vacuum distillation tower and collecting low-boiling point components under a reduced pressure.

Specifically, such a method can be employed as the atmospheric residue is distilled in the vacuum distillation tower so as to separate low-boiling point components and high-boiling point components of the atmospheric residue, while collecting the low-boiling point components as the vacuum gas oil from the top of the tower.

The vacuum distillation process can be carried out under a pressure in a range from 5 to 80 mmHg.

The temperature to which the crude oil is heated during the distillation process can be set so that components having boiling points lower than 550 to 650° C. are collected as the low-boiling point components.

(3) Vacuum Residue

Vacuum residue is produced by supplying the atmospheric residue to the vacuum distillation tower and collecting high-boiling point components under a reduced pressure.

Specifically, such a method can be employed as the atmospheric residue is distilled in the vacuum distillation tower so as to separate low-boiling point components and high-boiling point components of the atmospheric residue, while the high-boiling point components are collected as the vacuum residue from the bottom of the tower.

The vacuum distillation process can be carried out under a pressure in a range from 5 to 80 mmHg.

The temperature to heat the crude oil during the distillation process can be set so that components having boiling points of 550 to 650° C. or higher are collected as the high-boiling point components.

(4) Atmospheric Residuary Deasphalted Oil

Atmospheric residuary deasphalted oil is produced by subjecting the atmospheric residue to solvent deasphalting process, in which gas oil component is extracted from the atmospheric residue by using a light hydrocarbon solvent such as propane, butane, pentane or hexane.

Specifically, such a method may be employed as the atmospheric residue is put into counterflow contact with the solvent in a solvent extraction tower, so as to crack the atmospheric residue into solvent deasphalted oil which is a light component and solvent deasphalted residue which is a heavy component, while the solvent deasphalted oil (light component) is collected together with the solvent from the top of the tower, with the solvent included in the collected product being removed by evaporation or the like.

Type of the solvent, proportion of the solvent, temperature and other conditions of the solvent deasphalting process are determined according to the properties of the atmospheric residue.

(5) Vacuum Residuary Deasphalted Oil

Vacuum residuary deasphalted oil is produced by subjecting the vacuum residue, which has been obtained by distillation of the crude oil under the reduced pressure, to solvent deasphalting process, in which oil components are extracted from the vacuum residue by using a light hydrocarbon solvent such as propane, butane, pentane or hexane.

Specifically, such a method may be employed as the vacuum residue is put into counterflow contact with the solvent in the solvent extraction tower, so as to crack the vacuum residue into solvent deasphalted oil which is a light component and solvent deasphalted residue which is a heavy component, while collecting the solvent deasphalted oil (light component).

The feed oil used may be a blend of two or more selected from among the atmospheric residue, the vacuum gas oil, the vacuum residue, the atmospheric residuary deasphalted oil and the vacuum residuary deasphalted oil.

According to the present invention, feed oil which includes a high sulfur content (4 wt %, for example, or higher) can be used.

Feed oil preferably used in the present invention is the vacuum residue, the atmospheric residuary deasphalted oil or the vacuum residuary deasphalted oil. Use of these species as the feed oil improves the effects of decreasing the viscosity and pour point of the refined oil.

In the manufacturing method of the present invention, the feed oil is supplied through the feed pipe 10 and hydrogen is supplied through the feed pipe 11, both being introduced into the catalytic reaction tower 7 through the feed pipe 8.

Proportion of hydrogen to the feed oil is preferably in a range from 200 to 1000 $Nm^3/kL$, more preferably from 400 to 800 $Nm^3/kL$.

When the proportion of hydrogen is less than the range described above, demetalizing/desulfurizing reaction and hydrogenolysis catalytic reaction in the catalyst layers 4 and 6 may not proceed sufficiently while an excessive proportion of hydrogen beyond the above range increases the cost and is therefore undesirable.

The feed rate of hydrogen is preferably set so that the partial pressure of hydrogen in the catalytic reaction tower 7 falls in a range from 50 to 160 $kg/cm^2$, more preferably in a range from 70 to 140 $kg/cm^2$.

When the hydrogen feed rate is less than the range described above, demetalizing/desulfurizing reaction and hydrogenolysis catalytic reaction in the catalyst layers 4 and 6 may not proceed sufficiently while an excess hydrogen supply beyond the above range increases the cost and is therefore undesirable.

The feed oil and hydrogen supplied to the catalytic reaction tower 7 are introduced into the demetalizing/desulfurizing catalyst layer 4 and make contact with the demetalizing/desulfurizing catalyst 3 while flowing down through the layer.

For the rate of supplying the feed oil and hydrogen to the catalyst layer 4, liquid space velocity (LHSV) is preferably set in a range from 0.1 to 3/hr, more preferably from 0.2 to 2/hr. The liquid space velocity less than the above range decreases the production efficiency, while the liquid space velocity higher than the above range may lead to insufficient demetalizing/desulfurizing reaction in the catalyst layer 4.

The reaction temperature of the catalyst layer 4 is preferably set in a range from 310 to 460° C., more preferably in a range from 340 to 420° C.

A temperature lower than the above range may lead to insufficient demetalizing/desulfurizing reaction in the catalyst layer 4, and a temperature higher than the above range may decrease the yield and quality of the refined oil due to decomposition of the feed oil.

Metals (vanadium, nickel, etc.) included in the feed oil react with hydrogen due to the activity of the demetalizing/desulfurizing catalyst 3, so that the bond of the metals with the feed oil is cracked, with the metals being separated from the feed oil so as to be adsorbed on the surface of the catalyst 3 and removed. When feed oil including a vanadium content higher than 150 wt ppm is processed, however, it increases the cost and it is not practical to decrease the vanadium content of the refined oil to 0.5 wt ppm or less. Thus, in order to prepare refined oil of vanadium content less than 0.5 wt ppm which is suitable for gas turbine oil, it is necessary to use feed oil which includes vanadium content not higher than 150 wt ppm.

The sulfur contained in the feed oil is reduced to hydrogen sulfide or the like through reaction with hydrogen, and is separated and removed from the feed oil. Besides the metals and sulfur, other impurities (nitrogen, carbon) which are bonded with molecules of the feed oil are also separated from the feed oil through the reaction with hydrogen.

Moreover, a part of the feed oil is decomposed, through reaction with hydrogen by the action of the demetalizing/desulfurizing catalyst 3, into smaller molecules so that the viscosity and pour point are decreased.

The feed oil and hydrogen which have passed the demetalizing/desulfurizing catalyst layer 4 are introduced into the hydrogenolysis catalyst layer 6 that is installed downstream, and make contact with the hydrogenolysis catalyst 5 while flowing down through the hydrogenolysis catalyst layer 6.

For the rate of supplying the feed oil and hydrogen to the catalyst layer 6, liquid space velocity (LHSV) is preferably set in a range from 2 to 40/hr, more preferably from 3 to 30/hr. When the liquid space velocity is less than the above range, the production efficiency decreases, while the liquid space velocity higher than the above range may lead to insufficient reaction in the hydrogenolysis catalyst layer 6.

The reaction temperature of the catalyst layer 6 is preferably set in a range from 310 to 460° C., more preferably in a range from 340 to 420° C.

When the temperature is lower than the above range, it may lead to insufficient hydrogenolysis reaction in the catalyst layer 6, and a temperature higher than the above range may lower the quality of the refined oil due to decomposition of the feed oil.

Operating conditions such as hydrogen feed rate, liquid space velocity and temperature in the catalyst layers 4 and 6 are not limited to the preferable values described above, but can be set to appropriate levels according to the concentrations of metals, sulfur and residual carbon and the properties (viscosity, etc.) of the feed oil.

A part of the feed oil is decomposed into smaller molecules through reaction with hydrogen by the action of the hydrogenolysis catalyst 5. As a result, viscosity and the pour point of the feed oil are significantly decreased.

Part of sulfur content in the feed oil is reduced into hydrogen sulfide or the like through reaction with hydrogen, and is separated and removed from the feed oil.

The processes described above produce the refined oil having a viscosity of 20 cst or lower at 135° C., a pour point of 30° C. or lower, an alkali metal content of 1 wt ppm or less, a vanadium content of 10 wt ppm or less and a sulfur content of 0.3 wt % or lower.

When feed oil including a vanadium content not higher than 150 wt ppm is used, refined oil can be prepared that has a viscosity of 20 cst or lower at 135° C., an alkali metal content of 1 wt ppm or less, a vanadium content of 0.5 wt ppm or less and a sulfur content of 0.3 wt % or lower.

The refined oil which has passed the hydrogenolysis catalyst layer 6 reaches the bottom of the catalytic reaction tower 7, and is introduced into the hydrogen sulfide removing process through the discharge pipe 9.

In the hydrogen sulfide removing process, besides hydrogen sulfide, light hydrocarbons such as methane, ethane, and propane are removed from the refined oil during processes such as distillation.

The refined oil, from which the hydrogen sulfide and light hydrocarbons having been removed, is discharged to the outside as a product oil.

The refined oil has additional characteristics such that it is not necessary to apply heating or high-pressure processing for any applications and good processing characteristics can be achieved, since the viscosity is 20 cst or lower at 135° C. and the pour point is 30° C. or lower.

Also, the alkali metal content and the vanadium content of the refined oil can be decreased to 1 wt ppm or less and 0.5 wt ppm or less, respectively, in the case where the feed oil including vanadium content not higher than 150 wt ppm is used, and therefore such problems as melting and deterioration of the component members of the turbine can be prevented when the refined oil is used as gas turbine fuel oil.

The manufacturing method of this embodiment, in which the feed oil is brought into contact with hydrogen in the presence of the demetalizing/desulfurizing catalyst 3 and the hydrogenolysis catalyst 5, can not only decrease the concentrations of impurities such as metals (alkali metal, vanadium, etc.) and sulfur to sufficiently low levels by means of the demetalizing/desulfurizing catalyst 3, but can also decompose a part of the feed oil into smaller molecules with the hydrogenolysis catalyst 5, Thus, resulting in lower viscosity.

Thus, the following effects can be achieved.

(1) Even when a heavy oil is used as the feed oil, viscosity and pour point of the refined oil prepared can be lowered to satisfactory levels. This makes it possible to produce a refined oil having superior characteristics which does not require heating operation or high-pressure processing.

(2) Refined oil having viscosity and pour point which are sufficiently low can be prepared even when the conditions of reactions in the fractional distillation process and the solvent deasphalting process are set so as to maintain a favorable level of yield when refining the feed oil. Thus, it becomes possible to improve the yield of producing the refined oil and decrease the production cost.

(3) Refined oil having viscosity and pour point which are sufficiently low can be prepared even when the temperature and pressure of reaction during contact of the feed oil with hydrogen are set lower than those in the prior art process which uses demetalizing/desulfurizing catalyst only. Thus, the operating cost and the equipment cost of the catalytic reaction tower 7 can be kept low.

(4) Since the separation of sulfur from the feed oil is accelerated by the hydrogenolysis catalyst 5, refined oil having low sulfur content can be prepared even when feed oil which includes high sulfur content is used.

(5) When feed oil having a vanadium content of 150 wt ppm or less is used, in particular, refined oil having a vanadium content of 0.5 wt ppm or less can be prepared, which can be preferably used as the gas turbine fuel oil.

With the effects (1) to (5) described above, the method of this embodiment can lower the viscosity, pour point and sulfur content of the refined oil to sufficiently low levels and keep the production cost to a low level.

When atmospheric residue is used as the feed oil, the production cost can be reduced further. This is because the atmospheric residue can be manufactured under atmospheric pressure and therefore can be manufactured at a lower cost.

When vacuum gas oil which is obtained by vacuum distillation of the atmospheric residue or vacuum residue is used as the feed oil, then refined oil of uniform properties and superior combustion characteristic can be prepared since the feed oil having homogeneous properties can be used in manufacturing.

This is for the following reasons. The atmospheric residue has a high boiling point and therefore requires it to be heated to a high temperature when distilled under atmospheric pressure, which increases the probability of deterioration due to thermal decomposition. When the atmospheric residue is distilled under a reduced pressure, in contrast, the distillation process can be carried out at a relatively lower pressure which makes it possible to prevent thermal decomposition and condense components which have boiling points in a particular range. As a consequence, feed oil having homogeneous properties such as molecular weight can be obtained.

When oil prepared from atmospheric residue or vacuum residue by solvent deasphalting is used as the feed oil, the production cost can be reduced.

This is because the solvent deasphalted residue contains less heavy components and therefore the hydrogenation refining process can be carried out under less demanding conditions (pressure, temperature, etc.).

According to the method of this embodiment, since the feed oil and hydrogen are introduced into the hydrogenolysis catalyst layer 6 after passing the demetalizing/desulfurizing catalyst layer 4, concentrations of impurities (such as sulfur), viscosity and pour point of the feed oil are decreased in the demetalizing/desulfurizing catalyst layer 4, and the concentrations of impurities (such as sulfur), viscosity and pour point decrease further in the hydrogenolysis catalyst layer 6.

As a result, the refined oil which is superior in the impurity concentration and viscosity can be obtained.

The embodiment described above is a method of using the catalytic reaction tower 7 which comprises the demetalizing/desulfurizing catalyst layer 4 and the hydrogenolysis catalyst layer 6 that are housed in an external container 2; however, the present invention is not limited to this method.

Figure 2:
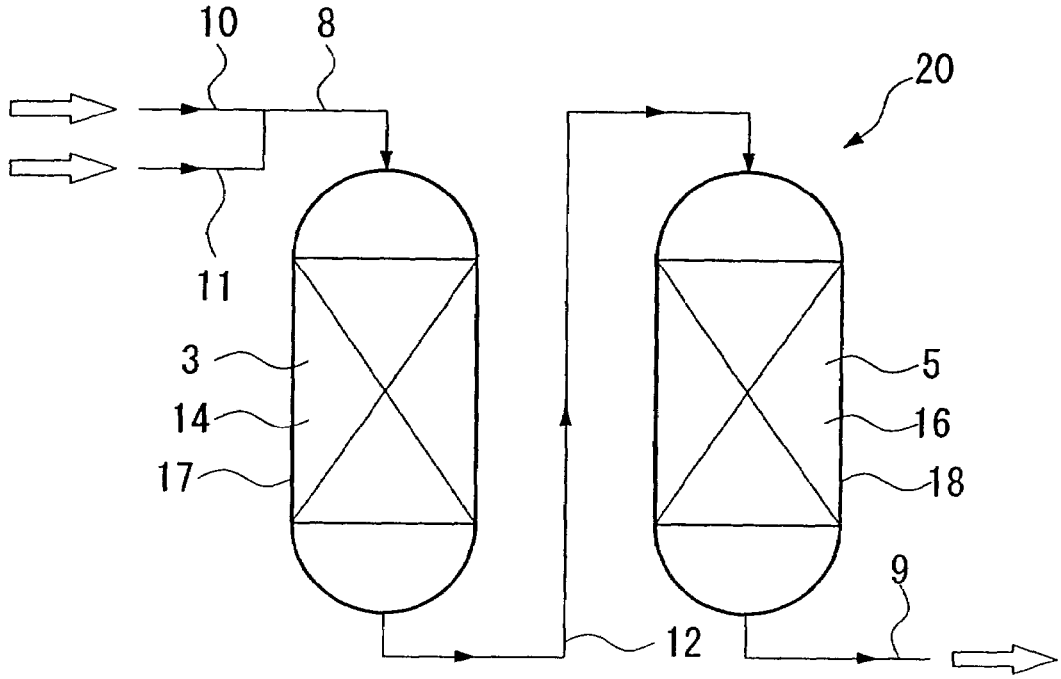
FIG. 2 is a schematic diagram showing a manufacturing apparatus preferably used for implementing another embodiment of the method of manufacturing refined oil of the present invention.

FIG. 2 schematically shows the construction of a manufacturing apparatus which can be used in another embodiment of the method of manufacturing the refined oil according to the invention. The manufacturing apparatus 20 has first and second catalytic reaction towers 17 and 18 while the first catalytic reaction tower 17 has a demetalizing/desulfurizing catalyst layer 14 consisting of the demetalizing/desulfurizing catalyst 3 and the second catalytic reaction tower 18 has a hydrogenolysis catalyst layer 16 consisting of the hydrogenolysis catalyst 5.

When the refined oil is prepared by the manufacturing apparatus 20, such a method can be employed as the feed oil is supplied to the first catalytic reaction tower 17 so as to pass through the demetalizing/desulfurizing catalyst layer 14, and the reaction product Thus, obtained is supplied through a pipe 12 to the second catalytic reaction tower 18 so as to pass through the hydrogenolysis catalyst layer 16.

In this case, since the two catalytic reaction towers 17 and 18 are used, the process conditions in the demetalizing/desulfurizing catalyst layer 14 and the process conditions in the hydrogenolysis catalyst layer 16 can be set independently from each other. Therefore, the process conditions in the two processes can be optimized individually, Thus, making it possible to improve the reaction efficiency.

Thus, a refined oil which is superior in the viscosity and the impurity concentration can be obtained. The yield of the refined oil can also be improved.

Figure 3:
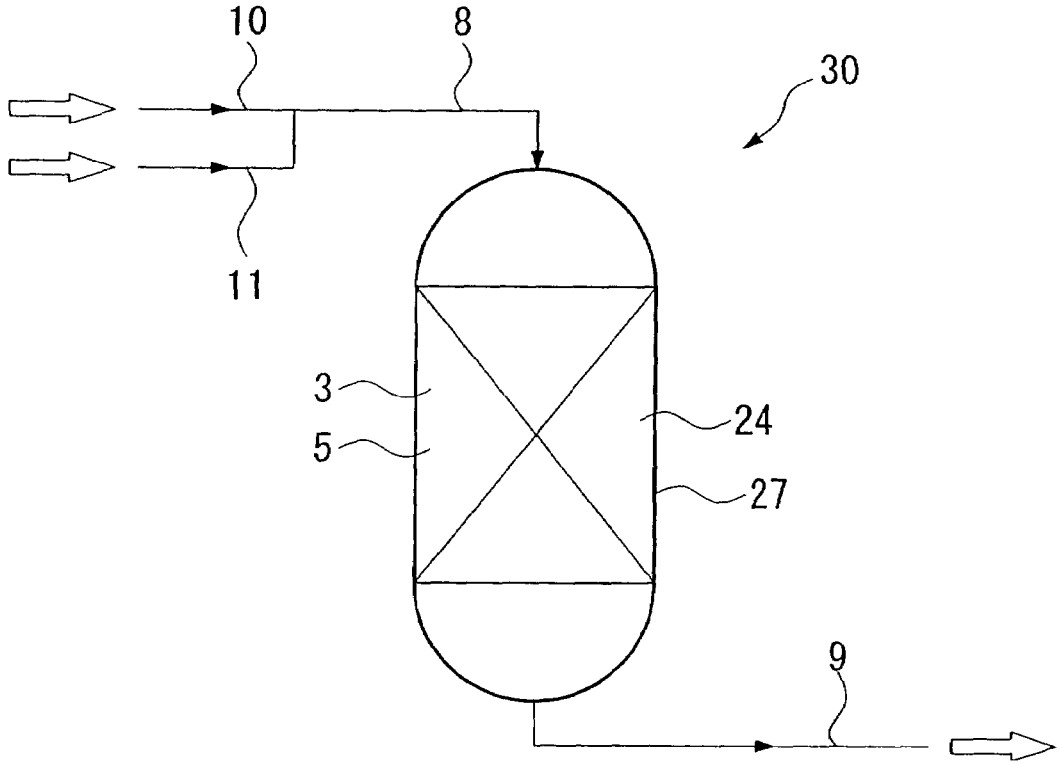
FIG. 3 is a schematic diagram showing a manufacturing apparatus preferably used for implementing yet another embodiment of the method of manufacturing refined oil of the present invention.

FIG. 3 schematically shows the construction of a manufacturing apparatus which can be used in yet another embodiment of the method of manufacturing the refined oil according to the present invention. The manufacturing apparatus 30 has a catalytic reaction tower 27 comprising a demetalizing, desulfurizing and hydrogenolysis catalyst layer 24 which is charged with a mixture of the demetalizing/desulfurizing catalyst 3 and the hydrogenolysis catalyst 5.

When the refined oil is prepared by the manufacturing apparatus 30, the feed oil is supplied to the catalytic reaction tower 27 so as to pass through the demetalizing, desulfurizing & hydrogenolysis catalyst layer 24.

This method makes it possible to simplify the structure of the catalytic reaction tower 27 and minimize the equipment cost.

According to the present invention, from the view point of simplifying the apparatus and the catalytic performance, it is desirable to charge the demetalizing/desulfurizing catalyst and the hydrogenolysis catalyst together in a single reaction vessel.

It is especially desirable to use a reactor vessel wherein a layer comprising the demetalizing/desulfurizing catalyst is installed upstream of a layer comprising the hydrogenolysis catalyst in the direction of feed oil flow.

EXAMPLES

Experimental Example 1

Refined oil suitable for gas turbine fuel oil was manufactured using the manufacturing apparatus 1 shown in FIG. 1.

Specifications of the apparatus and the process conditions are as follows.

Demetalizing/desulfurizing catalyst 3: An alumina carrier with nickel (2 wt %) and molybdenum (8 wt %) supported on the surface thereof. Cylindrical shape 1 mm in diameter and 3 to 5 mm long.

Demetalizing/desulfurizing catalyst layer 4: 25 mm in diameter and 2000 mm in stack height.

Hydrogenolysis catalyst 5: A silica-alumina carrier with nickel-tungsten (8 wt %) supported thereon. Cylindrical shape 1 mm in diameter and 3 to 5 mm long.

Hydrogenolysis catalyst layer 6: 25 mm in diameter and 34 mm in stack height.

Feed oil: Atmospheric residue (component having boiling point 370° C. or higher) extracted from Arabian light crude oil.

The feed oil described above and hydrogen were supplied through the feed pipe 8 into the catalytic reaction tower 7, so as to pass through the demetalizing/desulfurizing catalyst layer 4 and the hydrogenolysis catalyst layer 6, and reaction product was taken out from the discharge pipe 9.

Comparative Example 1

Refined oil was prepared with a manufacturing apparatus similar to that which was used in Experimental Example 1, except that it was not provided with the hydrogenolysis catalyst layer 6.

Tests were conducted similarly to Experimental Example 1.

Results of analyzing the feed oil and the reaction product are shown in Table 1 along with the process conditions.

TABLE 1

| | Experimental Example 1 | | Comp. Example 1 | |
|---|---|---|---|---|
| | Feed oil | Reaction product | Feed oil | Reaction product |
| Density at 15° C. (g/cm$^3$) | 0.962 | 0.914 | 0.962 | 0.918 |
| Kinetic viscosity at 135° C. (cst) | 51 | 4 | 51 | 10 |
| Pour point (° C.) | 32 | 5 | 32 | 20 |
| Sulfur content (wt %) | 3.12 | 0.21 | 3.12 | 0.31 |
| Nitrogen content (wt ppm) | 1850 | 520 | 1850 | 570 |
| Conradson carbon (wt %) | 9.1 | 1.2 | 9.1 | 1.8 |
| Vanadium content (wt ppm) | 35 | <0.5 | 35 | <0.5 |
| Alkali metal content (wt ppm) | 5 | <0.5 | 5 | <0.5 |
| Temperature (° C.) | 380 | | 380 | |
| Partial pressure of hydrogen (kg/cm$^2$) | 120 | | 120 | |
| Hydrogen/feed oil ratio (Nm$^3$/kL) | 800 | | 800 | |
| Liquid space velocity (LHSV) in demetalizing/desulfurizing catalyst layer (l/h) | 0.2 | | 0.2 | |
| Liquid space velocity (LHSV) in hydrogenolysis catalyst layer (l/h) | 12 | | — | |
| Yield of refined oil (wt %) | 95.3 | | 96.2 | |

Experimental Example 2

Refined oil which could be preferably used as the gas turbine fuel oil was prepared using vacuum gas oil (boiling point from 370 to 565° C.) extracted from Kafji crude oil as the feed oil.

Comparative Example 2

Refined oil was prepared by a manufacturing apparatus similar to that which was used in Experimental Example 2, except that it was not provided with the hydrogenolysis catalyst layer 6.

Tests were conducted similarly to Experimental Example 2.

Results of analyzing the feed oil and the reaction product are shown in Table 2 along with the process conditions.

TABLE 2

| | Experimental Example 2 | | Comp. Example 2 | |
|---|---|---|---|---|
| | Feed oil | Reaction product | Feed oil | Reaction product |
| Density at 15° C. (g/cm$^3$) | 0.938 | 0.883 | 0.938 | 0.885 |
| Kinetic viscosity at 135° C. (cst) | 24 | 2 | 24 | 8 |
| Pour point (° C.) | 36 | 0 | 36 | 18 |
| Sulfur content (wt %) | 3.21 | 0.08 | 3.21 | 0.1 |
| Nitrogen content (wt ppm) | 1090 | 180 | 1090 | 220 |
| Conradson carbon (wt %) | 0.75 | <0.1 | 0.75 | <0.1 |
| Vanadium content (wt ppm) | 2 | <0.5 | 2 | <0.5 |
| Alkali metal content (wt ppm) | 0.5 | <0.5 | 0.5 | <0.5 |
| Temperature (° C.) | 352 | | 352 | |

TABLE 2-continued

| | Experimental Example 2 | | Comp. Example 2 | |
|---|---|---|---|---|
| | Feed oil | Reaction product | Feed oil | Reaction product |
| Partial pressure of hydrogen (kg/cm$^2$) | 60 | | 60 | |
| Hydrogen/feed oil ratio (Nm$^3$/kL) | 300 | | 300 | |
| Liquid space velocity (LHSV) in demetalizing/desulfurizing catalyst layer (l/h) | 1.8 | | 1.8 | |
| Liquid space velocity (LHSV) in hydrogenolysis catalyst layer (l/h) | 30 | | — | |
| Yield of refined oil (wt %) | 98.0 | | 98.3 | |

Experimental Example 3

Refined oil which could be preferably used as the gas turbine fuel oil was prepared using vacuum-cracked residue oil (boiling point 565° C. or higher) extracted from Arabian light crude oil as the feed oil.

Comparative Example 3

Refined oil was prepared with a manufacturing apparatus similar to that which was used in Experimental Example 3, except that it was not provided with the hydrogenolysis catalyst layer 6.

Tests were conducted similarly to Experimental Example 3.

Results of analyzing the feed oil and the reaction product are shown in Table 3 along with the process conditions.

TABLE 3

| | Experimental Example 3 | | Comp. Example 3 | |
|---|---|---|---|---|
| | Feed oil | Reaction product | Feed oil | Reaction product |
| Density at 15° C. (g/cm$^3$) | 1.018 | 0.945 | 1.018 | 0.955 |
| Kinetic viscosity at 135° C. (cst) | 1320 | 18 | 1320 | 180 |
| Pour point (° C.) | 53 | 25 | 53 | 35 |
| Sulfur content (wt %) | 4.02 | 0.3 | 4.02 | 0.9 |
| Nitrogen content (wt ppm) | 3100 | 650 | 3100 | 950 |
| Conradson carbon (wt %) | 14.5 | 1.4 | 14.5 | 3.2 |
| Vanadium content (wt ppm) | 65 | <0.5 | 65 | <0.5 |
| Alkali metal content (wt ppm) | 21 | <0.5 | 21 | <0.5 |
| Temperature (° C.) | 390 | | 390 | |
| Partial pressure of hydrogen (kg/cm$^2$) | 160 | | 160 | |
| Hydrogen/feed oil ratio (Nm$^3$/kL) | 1000 | | 1000 | |
| Liquid space velocity (LHSV) in demetalizing/desulfurizing catalyst layer (l/h) | 0.1 | | 0.1 | |
| Liquid space velocity (LHSV) in hydrogenolysis catalyst layer (l/h) | 10 | | — | |

TABLE 3-continued

| | Experimental Example 3 | | Comp. Example 3 | |
|---|---|---|---|---|
| | Feed oil | Reaction product | Feed oil | Reaction product |
| Yield of refined oil (wt %) | 91.5 | | 93.5 | |

Experimental Example 4

Refined oil which could be preferably used as the gas turbine fuel oil was prepared by using atmospheric residuary deasphalted oil, which was obtained by deasphalting the atmospheric residue (component having boiling point 370° C. or higher) of Arabian heavy crude oil in a solvent deasphalting apparatus, as the feed oil. Yield of producing the atmospheric residuary deasphalted oil by deasphalting the atmospheric residue was 95 wt %.

Comparative Example 4

Refined oil was prepared by a manufacturing apparatus similar to that which was used in Experimental Example 4, except that it was not provided with the hydrogenolysis catalyst layer 6.

Tests were conducted similarly to Experimental Example 4.

Results of analyzing the feed oil and the reaction product are shown in Table 4 along with the process conditions.

TABLE 4

| | Experimental Example 4 | | Comp. Example 4 | |
|---|---|---|---|---|
| | Feed oil | Reaction product | Feed oil | Reaction product |
| Density at 15° C. (g/cm$^3$) | 0.949 | 0.894 | 0.949 | 0.896 |
| Kinetic viscosity at 135° C. (cst) | 35 | 4 | 35 | 13 |
| Pour point (° C.) | 25 | −5 | 25 | 15 |
| Sulfur content (wt %) | 3.51 | 0.25 | 3.51 | 0.31 |
| Nitrogen content (wt ppm) | 1350 | 440 | 1350 | 480 |
| Conradson carbon (wt %) | 6.5 | 1.1 | 6.5 | 1.3 |
| Vanadium content (wt ppm) | 25 | <0.5 | 25 | <0.5 |
| Alkali metal content (wt ppm) | 10 | <0.5 | 10 | <0.5 |
| Temperature (° C.) | 365 | | 365 | |
| Partial pressure of hydrogen (kg/cm$^2$) | 100 | | 100 | |
| Hydrogen/feed oil ratio (Nm$^3$/kL) | 600 | | 600 | |
| Liquid space velocity (LHSV) in demetalizing/desulfurizing catalyst layer (l/h) | 0.3 | | 0.3 | |
| Liquid space velocity (LHSV) in hydrogenolysis catalyst layer (l/h) | 25 | | — | |
| Yield of refined oil (wt %) | 98 | | 98.8 | |

Experimental Example 5

Refined oil which could be preferably used as the gas turbine fuel oil was prepared using deasphalted vacuum-distilled oil, which was obtained by deasphalting the vacuum residue (component having boiling point of 565° C. or higher) of Arabian heavy crude oil in a solvent deasphalting apparatus, as the feed oil.

Yield of producing the deasphalted vacuum-distilled oil by deasphalting the vacuum residue was 71 wt %.

Comparative Example 5

Refined oil was prepared by a manufacturing apparatus similar to that which was used in Experimental Example 5, except that it was not provided with the hydrogenolysis catalyst layer 6.

Tests were conducted similarly to Experimental Example 5.

Results of analyzing the feed oil and the reaction product are shown in Table 5 along with the process conditions.

TABLE 5

| | Experimental Example 5 | | Comp. Example 5 | |
|---|---|---|---|---|
| | Feed oil | Reaction product | Feed oil | Reaction product |
| Density at 15° C. (g/cm$^3$) | 0.998 | 0.936 | 0.998 | 0.939 |
| Kinetic viscosity at 135° C. (cst) | 395 | 8 | 395 | 23 |
| Pour point (° C.) | 38 | 10 | 38 | 25 |
| Sulfur content (wt %) | 4.41 | 0.21 | 4.41 | 0.29 |
| Nitrogen content (wt ppm) | 2650 | 480 | 2650 | 520 |
| Conradson carbon (wt %) | 13.5 | 0.9 | 13.5 | 1.1 |
| Vanadium content (wt ppm) | 55 | <0.5 | 55 | <0.5 |
| Alkali metal content (wt ppm) | 12 | <0.5 | 12 | <0.5 |
| Temperature (° C.) | 370 | | 370 | |
| Partial pressure of hydrogen (kg/cm$^2$) | 130 | | 130 | |
| Hydrogen/feed oil ratio (Nm$^3$/kL) | 800 | | 800 | |
| Liquid space velocity (LHSV) in demetalizing/desulfurizing catalyst layer (l/h) | 0.3 | | 0.3 | |
| Liquid space velocity (LHSV) in hydrogenolysis catalyst layer (l/h) | 25 | | — | |
| Yield of refined oil (wt %) | 98 | | 98.8 | |

Experimental Example 6

Refined oil was prepared using vacuum residue (component having boiling point 565° C. or higher) extracted from Kafji crude oil, as the feed oil.

Comparative Example 6

Refined oil was prepared by a manufacturing apparatus similar to that which was used in Experimental Example 6, except that it was not provided with the hydrogenolysis catalyst layer 6.

Tests were conducted similarly to Experimental Example 6.

Results of analyzing the feed oil and the reaction product are shown in Table 6 along with the process conditions.

TABLE 6

| | Experimental Example 6 | | Comp. Example 6 | |
|---|---|---|---|---|
| | Feed oil | Reaction product | Feed oil | Reaction product |
| Density at 15° C. (g/cm$^3$) | 1.050 | 0.955 | 1.050 | 0.965 |
| Kinetic Viscosity at 135° C. (cst) | 9800 | 19 | 9800 | 250 |
| Pout point (° C.) | 53 | 25 | 53 | 35 |
| Sulfur content (wt %) | 5.78 | 0.3 | 5.78 | 1.2 |
| Nitrogen content (wt ppm) | 4600 | 750 | 4600 | 1050 |
| Conradson carbon (wt %) | 23.5 | 1.9 | 23.5 | 3.9 |
| Vanadium content (wt ppm) | 190 | 8 | 190 | 21 |
| Alkali metal content (wt ppm) | 25 | <0.5 | 25 | 3 |
| Temperature (° C.) | 400 | | 400 | |
| Partial pressure of hydrogen (kg/cm$^2$) | 160 | | 160 | |
| Hydrogen/feed oil ratio (Nm$^3$/kL) | 1000 | | 1000 | |
| Liquid space velocity (LHSV) in demetalizing/desulfurizing catalyst layer (l/h) | 0.1 | | 0.1 | |
| Liquid space velocity (LHSV) in hydrogenolysis catalyst layer (l/h) | 10 | | — | |
| Yield of refined oil (wt %) | 90.5 | | 92.5 | |

As can be seen from Tables 1 to 6, viscosity and pour point of the reaction product could be decreased to satisfactory levels in Experimental Examples 1 to 6, in contrast to Comparative Examples 1 to 6.

Also in Experimental Examples 1 to 6, concentrations of impurities (sulfur, nitrogen, carbon, vanadium, and alkali metals) could be made lower than those of Comparative Examples 1 to 6.

Particularly in Experimental Examples 1 to 5, refined oil suitable for gas turbine fuel oil was prepared.

From the above description, it is clear that refined oil having superior properties such as viscosity and impurity concentration can be prepared by using the methods of Experimental Examples from any of the six species of feed oil which have different properties.

INDUSTRIAL APPLICABILITY

According to the method of manufacturing refined oil of the present invention, viscosity and pour point of the refined oil prepared can be decreased to sufficiently low levels even when heavy oil is used as the feed oil. This makes it possible to produce a refined oil having superior characteristics which does not require heating operation or high-pressure processing.

The invention claimed is:

1. A method of manufacturing refined oil, which comprises the step of bringing feed oil into contact with hydrogen in the presence of a demetalizing/desulfurizing catalyst and a hydrogenolysis catalyst to obtain the refined oil having a viscosity of 20 cst or lower at 135° C., a pour point of 30° C. or lower, an alkali metal content of 1 wt ppm or less, a vanadium content of 10 wt ppm or less, and a sulfur content of 0.3 wt % or lower, wherein:

the demetalizing/desulfurizing catalyst includes a carrier that contains at least one of alumina and silica-alumina, and the carrier supports at least one member selected from the group consisting of nickel, cobalt, molybdenum, and tungsten;

the hydrogenolysis catalyst includes a component having cracking capability, or isomerization activity and a component having hydrogenation activity;

the component having cracking activity or isomerization activity is at least one member selected from the group consisting of silica, alumina, magnesia, zirconia, boria, titania, calcia and zinc oxide;

the component having hydrogenation activity is at least one member selected from the group consisting of nickel, cobalt, molybdenum, platinum, chromium, tungsten, iron, and palladium;

the liquid space velocity (LHSV) of the feed oil and the hydrogen with respect to the demetalizing/desulfurizing catalyst is set to a range of 0.1 to 3/hr;

the liquid space velocity (LHSV) of the feed oil and the hydrogen with respect to the hydrogenolysis catalyst is set to a range of 10 to 30/hr; and the feed rate of hydrogen is set so that the partial pressure of hydrogen falls in a range from 50 to 160 kg/cm$^2$.

2. A method of manufacturing refined oil, which comprises the step of bringing feed oil having a vanadium content of 150 wt ppm or less into contact with hydrogen in the presence of a demetalizing/desulfurizing catalyst and a hydrogenolysis catalyst to obtain the refined oil to be used as gas turbine fuel oil having a viscosity of 20 cst or lower at 135° C., a pour point of 30° C. or lower, an alkali metal content of 1 wt ppm or less, a vanadium content of 0.5 wt ppm or less and a sulfur content of 0.3 wt % or lower, wherein:

the demetalizing/desulfurizing catalyst includes a carrier that contains at least one of alumina and silica-alumina, and the carrier supports at least one member selected from the group consisting of nickel, cobalt, molybdenum, and tungsten;

the hydrogenolysis catalyst includes a component having cracking capability, or isomerization activity and a component having hydrogenation activity;

the component having cracking activity or isomerization activity is at least one member selected from the group consisting of silica, alumina, magnesia, zirconia, boria, titania, calcia and zinc oxide;

the component having hydrogenation activity is at least one member selected from the group consisting of nickel, cobalt, molybdenum, platinum, chromium, tungsten, iron, and palladium;

the liquid space velocity (LHSV) of the feed oil and the hydrogen with respect to the demetalizing/desulfurizing catalyst is set to a range of 0.1 to 3/hr;

the liquid space velocity (LHSV) of the feed oil and the hydrogen with respect to the hydrogenolysis catalyst is set to a range of 10 to 30/hr; and the feed rate of hydrogen is set so that the partial pressure of hydrogen falls in a range from 50 to 160 kg/cm$^2$.

3. The method of manufacturing refined oil according to claim 1 or 2, wherein atmospheric residue obtained by distilling crude oil under atmospheric pressure is used as the feed oil.

4. The method of manufacturing refined oil according to claim 1 or 2, wherein vacuum gas oil obtained by vacuum distillation of the atmospheric residue which was obtained by distillation of crude oil under atmospheric pressure is used as the feed oil.

5. The method of manufacturing refined oil according to claim 1 or 2, wherein vacuum residue obtained by vacuum distillation of the atmospheric residue which was obtained by distillation of crude oil under atmospheric pressure is used as the feed oil.

6. The method of manufacturing refined oil according to claim 1 or 2, wherein atmospheric residuary deasphalted oil obtained by solvent deasphalting of the atmospheric residue which was obtained by distillation of crude oil under atmospheric pressure is used as the feed oil.

7. The method of manufacturing refined oil according to claim 1 or 2, wherein vacuum residuary deasphalted oil obtained by solvent deasphalting of the vacuum residue which was obtained by vacuum distillation of the atmospheric residue produced by distillation of crude oil under atmospheric pressure is used as the feed oil.

8. The method of manufacturing refined oil according to claim 1 or 2, wherein the feed oil consists of two or more kinds selected from among a group consisting of the atmospheric residue obtained by distilling the crude oil under atmospheric pressure, vacuum gas oil obtained by vacuum distillation of the atmospheric residue, vacuum residue obtained by vacuum distillation of the atmospheric residue, atmospheric residuary deasphalted oil obtained by solvent deasphalting of the atmospheric residue, and vacuum residuary deasphalted oil obtained by solvent deasphalting of the vacuum residue.

9. The method of manufacturing refined oil according to claim 1 or 2, wherein a heavy oil having boiling point of 340° C. or higher is used as the feed oil.

10. The method of manufacturing refined oil according to claim 1 or 2, wherein contact of the feed oil with hydrogen is carried out using a reactor vessel comprising a demetalizing/desulfurizing catalyst layer which consists of a demetalizing/desulfurizing catalyst and a hydrogenolysis catalyst layer which consists of a hydrogenolysis catalyst, with the demetalizing/desulfurizing catalyst layer being installed in the upstream of the hydrogenolysis catalyst layer in the direction of the feed oil flow, while the feed oil is brought into contact with hydrogen in the hydrogenolysis catalyst layer after making contact with hydrogen in the demetalizing/desulfurizing catalyst layer.

11. Refined oil prepared by the method of manufacturing the refined oil of claim 1 or 2.

12. The method of manufacturing refined oil according to claim 1 or 2, wherein the ratio of (i) the liquid space velocity (LHSV) of the feed oil and hydrogen with respect to the demetalizing/desulfurizing catalyst and (ii) the liquid space velocity (LHSV) of the feed oil and hydrogen to the hydrogenolysis catalyst is set to a range of 1:16.7 to 1:100.

13. The method of manufacturing refined oil according to claim 1 or 2, wherein the liquid space velocity (LHSV) of the feed oil and hydrogen with respect to the demetalizing/desulfurizing catalyst is set to a range of 0.2 to 2/hr, and the liquid space velocity (LHSV) of the feed oil and hydrogen with respect to the hydrogenolysis catalyst is set to a range of 3 to 30/hr.

14. The method of manufacturing refined oil according to claim 1 or 2, wherein contact of the feed oil with hydrogen is carried out using a reactor vessel comprising a demetalizing, desulfurizing and hydrogenolysis catalyst layer which includes a mixture of the demetalizing/desulfurizing catalyst and the hydrogenolysis catalyst, and the feed oil is brought into contact with hydrogen in the demetalizing, desulfurizing and hydrogenolysis catalyst layer.

* * * * *